US006354960B1

(12) United States Patent
Perryman et al.

(10) Patent No.: US 6,354,960 B1
(45) Date of Patent: Mar. 12, 2002

(54) GOLF CLUB SHAFT WITH CONTROLLABLE FEEL AND BALANCE USING COMBINATION OF FIBER REINFORCED PLASTICS AND METAL-COATED FIBER-REINFORCED PLASTICS

(75) Inventors: Michael W. Perryman, Carmel, IN (US); Patrick C. T. Hsu, Houli (TW)

(73) Assignee: Rapport Composites U.S.A., Inc., Indianapolis, IN (US)

( * ) Notice: Subject to any disclaimer, the term of this patent is extended or adjusted under 35 U.S.C. 154(b) by 0 days.

(21) Appl. No.: 09/337,356

(22) Filed: Jun. 21, 1999

Related U.S. Application Data

(60) Provisional application No. 60/090,743, filed on Jun. 24, 1998, and provisional application No. 60/118,886, filed on Feb. 5, 1999.

(51) Int. Cl.[7] ..... A63B 53/10; A63B 53/12

(52) U.S. Cl. ..... 473/319; 473/320; 473/318; 473/349

(58) Field of Search ..... 473/318, 319, 473/320

(56) References Cited

U.S. PATENT DOCUMENTS

| | | | | | |
|---|---|---|---|---|---|
| 4,135,035 | A | * | 1/1979 | Branen et al. | 428/377 |
| 4,188,032 | A | | 2/1980 | Yanagioka | |
| 4,836,545 | A | * | 6/1989 | Pompa | 273/80 B |
| 4,889,575 | A | * | 12/1989 | Roy | 156/189 |
| 4,942,090 | A | | 7/1990 | Morin | |
| 5,026,872 | A | | 6/1991 | Kohli | |
| 5,156,396 | A | | 10/1992 | Akatsuka et al. | |
| 5,188,152 | A | | 2/1993 | Ogawa | |
| 5,242,720 | A | | 9/1993 | Blake | |
| 5,324,032 | A | | 6/1994 | Minami | |
| 5,496,028 | A | | 3/1996 | Chien | |
| 5,578,386 | A | | 11/1996 | Bell et al. | |
| 5,597,631 | A | | 1/1997 | Furumoto et al. | |
| 5,601,892 | A | * | 2/1997 | McIntosh | 428/35.8 |
| 5,735,753 | A | * | 4/1998 | Hoffmeyer | 473/318 |
| 6,088,947 | A | * | 7/2000 | Suzue et al. | 473/319 |

* cited by examiner

*Primary Examiner*—Jeanette Chapman
*Assistant Examiner*—Sneh Varma
(74) *Attorney, Agent, or Firm*—Woodard, Emhardt, Naughton, Moriarty & McNett

(57) ABSTRACT

A golf club shaft is formed with an elongated body using a combination of fiber-reinforced plastics and metal-coated fibers to obtain the optimally characterized golf club for a particular player. In one embodiment, a sheet-rolled or filament wound core is covered by a filament wound outer layer having at least one ply including metal-coated fibers. The fibers can be metal-coated with metals such as: nickel, titanium, platinum, zinc, copper, brass, tungsten, cobalt, gold or silver. The use of metal-coated fibers allows the use of combinations of fiber reinforced plastic and metal-coated fibers in producing golf shafts with optimum performance properties. For example, the use of metal-coated fibers allows the addition of weight to the shaft without significantly influencing its longitudinal or torsional rigidity. In alternate embodiments, specific placement of the metal-coated fibers is possible to add weight to predetermined points in the shaft to shift the flex and balance points without varying the shaft's torsional properties and while providing the optimum flex for a given golf club design. In a still further example, two or more types of metal-coated fibers can be used at different portions on the shaft.

10 Claims, 8 Drawing Sheets

GOLF CLUB SHAFT WITH CONTROLLABLE FEEL AND BALANCE USING COMBINATION OF FIBER REINFORCED PLASTICS AND METAL-COATED FIBER-REINFORCED PLASTICS

This application claims priority to provisional application Ser. No. 60/090,743 filed Jun. 24, 1998 and provisional application Ser. No. 60/118,886 filed Feb. 5, 1999.

FIELD OF THE INVENTION

The present invention relates generally to the field of golf club shafts. In particular, the present invention involves the use of metal coated fibers in forming composite golf club shafts to provide controllable feel and balance.

BACKGROUND OF THE INVENTION

Frequently a golfer's goal is to send the golf ball a greater distance, or, when fatigue or age are factors, to maintain a certain hitting distance. Although traditional golf club shafts are made from steel, there is a need for golf clubs which are lighter and specialized alternatives to steel in order to achieve these goals. Graphite shafts have reduced weight, greater flex and strength than steel, providing benefits such as vibration dampening on mis-hits, greater distance and reduced physical stress on the wrist, shoulder and elbow. Accordingly, graphite shafts are gaining in acceptance. Traditionally however, graphite shafts have suffered from inconsistent manufacturing, higher costs, extra torque, a soft feel and higher breakage rates, particularly around the club head connection or hosel.

Graphite golf clubs have been made from many different materials and recently have become available in different combinations of composites using fiber reinforced plastics and metals. Composite graphite shafts have normally been made by either a sheet-rolling method or a filament winding method.

In the sheet-rolling or sheet-wrapping method, carbon, glass or other fibers are impregnated with a plastic resin and placed in a parallel matrix to form a broad sheet or prepreg. The prepreg is then cut into smaller sheets similar to a tapered flag shape with all of the fibers at a particular angle to the axis of the intended mandrel, the angle can be between 0° and 90°. These flags are then rolled around a mandrel to form various layers or plies. The layers are then cured to form a composite and the mandrel is removed.

In the filament winding method, fibers are collected into groups called "tows" and each tow is impregnated with resin and wrapped around the mandrel to form the layers prior to curing. Filament winding generally results in an improved shaft with greater consistency in manufacture. The resulting shafts are substantially lighter than traditional metal shafts.

Preferably a golf club including the shaft and head should be "tuned" or customized to a particular player or overall club design in terms of weight, balance, torque, impact strength and flex. Composite shafts have been criticized, among other reasons, as difficult to tune for particular players. For example, sheet-wrapped shafts have been criticized as providing too much torque to the ball, while filament wound shafts have been criticized as having greater breakage rates.

Moreover, a shaft's weight, balance, impact strength and flex are interdependent so that attempting to adjust one characteristic frequently has undesired effects on other attributes. For example, including a sufficient number of carbon-fiber layers to achieve a desired weight can make the shaft too thick, effecting its stiffness and balance. It would be desirable to customize particular attributes of a shaft while maintaining the desirable characteristics of graphite composites and not negatively impacting other attributes of play.

As some attempts to solve these problems, metals have been used in conjunction with composite shafts, but the combinations of materials and composites have not had the desired results. Use of metal reinforcement to date has consisted of using extruded tubing, amorphous metal tape wound as one or more layers of the shaft, or plating added to the outer layer of the shaft. These hybrid shafts, using combinations of fiber-reinforced plastics and metals, have yet to achieve widespread use due to higher material and production costs without significant performance improvement. While achieving one favorable effect, the weight, placement or design of the metals often effects other attributes undesirably.

One example of such an attempt is illustrated in U.S. Pat. No. 5,601,892 issued to McIntosh. McIntosh suggests sheet-rolled hollow rods formed with non-coated sheet-rolled inner plies covered by one or two plies of sheet-rolled nickel-coated flags. McIntosh suggests that the fibers in the outer plies be oriented substantially parallel to the rod axis. McIntosh states that this will increase impact strength. McIntosh fails to address the concerns of weight, balance and torque. Although McIntosh mentions to golf clubs, McIntosh focuses on fishing rods and does not address many of the specific concerns encountered in manufacturing golf club shafts. Thus there remains a need for improved golf club shafts.

The prior art does not allow for the easy placement of weight or altered weight designs within the golf shaft without significantly affecting other shaft performance attributes. While sometimes desirable, this is most often not the case.

SUMMARY OF THE INVENTION

A golf club shaft is formed with an elongated body using a combination of fiber-reinforced plastics and metal-coated fibers to assist in obtaining an optimally characterized golf club for a particular player. Preferably a sheet-rolled or filament wound core is covered by a filament wound outer layer having at least one ply including metal-coated fibers. The fibers can be coated with various metals such as nickel, titanium, platinum, zinc, copper, brass, tungsten, cobalt, gold or silver.

The use of metal-coated fibers allows the use of combinations of fiber reinforced plastic and metal-coated fibers in plies for producing golf shafts with optimum performance properties. For example, the use of metal-coated fibers allows the addition of weight to the shaft without significantly influencing its longitudinal or torsional rigidity. There has been a widespread, unsolved demand for this type of product. Metal-coated fibers can be used to enhance the feel and sensitivity of the golf club shaft to suit the needs of a particular design or player.

In alternate embodiments, specific placement of the metal-coated carbon fibers is possible through filament winding to add weight to predetermined points in the shaft to shift the flex and balance points without varying the shaft's torsional properties and while still providing the optimum flex for a given golf club design. In still further embodiments, fibers coated with different metals can be used to form different portions of the shaft.

It is an object of the invention to provide an improved golf club shaft.

It is another object of the invention to provide a golf club shaft which includes metal-coated fibers.

It is a further object of a preferred embodiment of the present invention to provide a composite graphite golf shaft used in forming a golf club which may be tuned for a particular player or overall club design.

Further objects, features and advantages of the present invention shall become apparent from the detailed drawings and descriptions provided herein.

DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Figure 1:
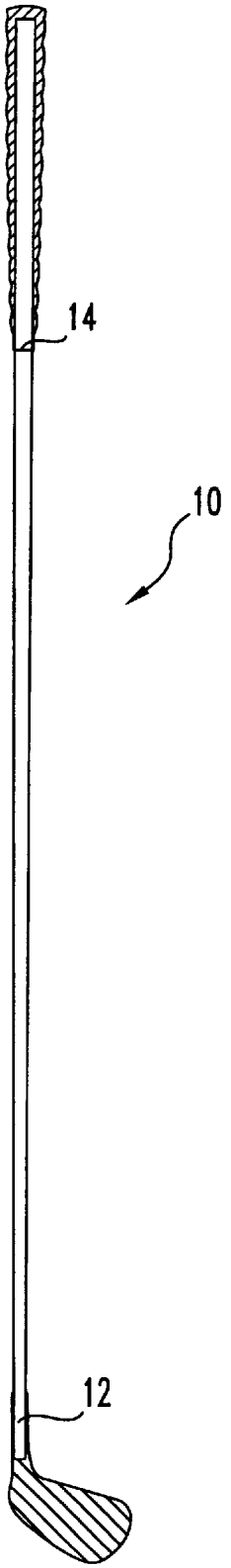
FIG. 1 is an illustration of a golf club.

The present invention provides an improved golf club shaft formed with an elongated body using a combination of fiber-reinforced plastics and metal-coated fibers to obtain an optimally characterized golf club for a particular player. A typical golf club made in accordance with the present invention is illustrated in FIG. 1, and includes shaft or body 10 with tip or hosel section 12 and butt or grip section 14.

Figure 2A:
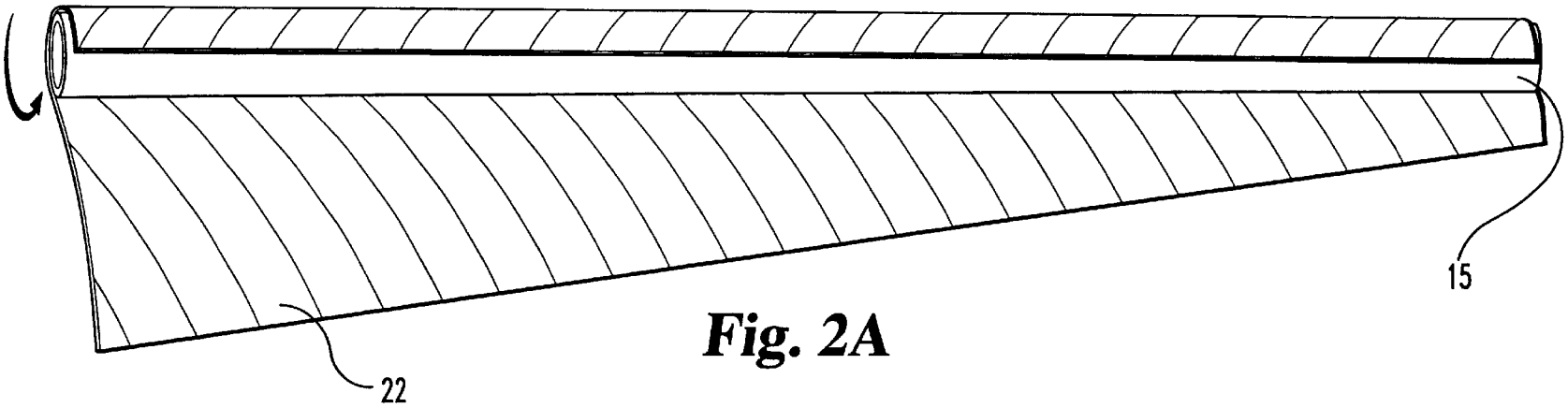
FIGS. 2A and 2B are perspective views of steps in a sheet-rolling process.
Figure 2B:
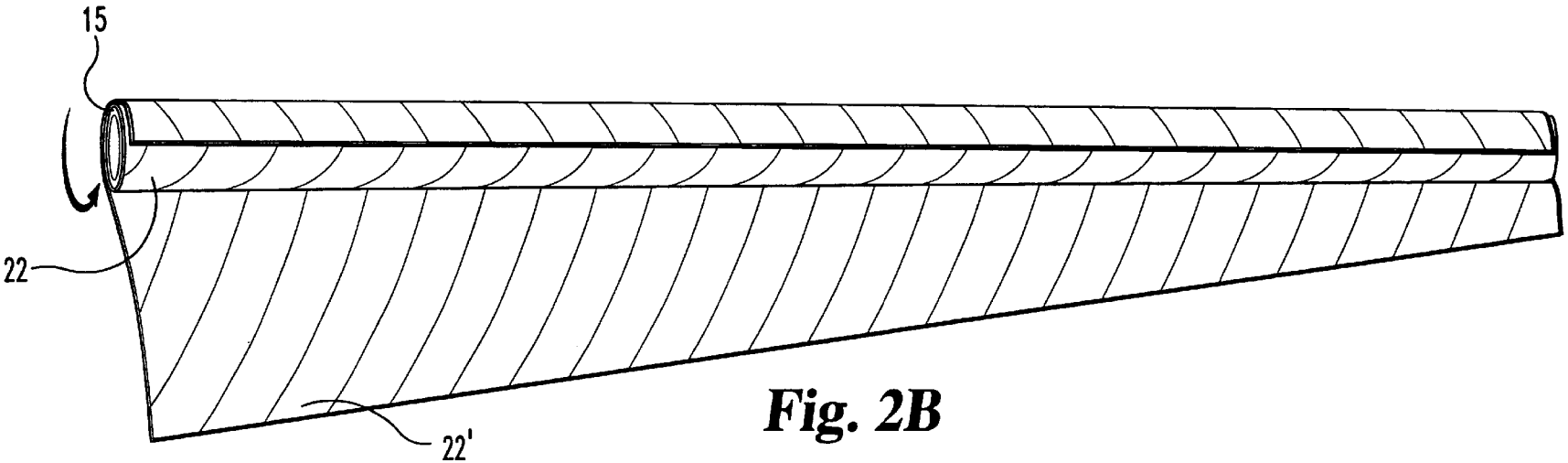
Figure 2C:
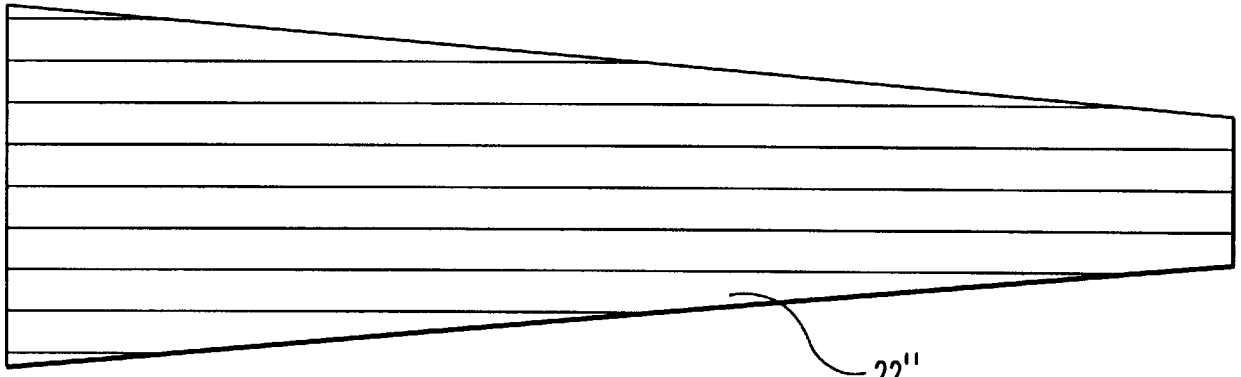
FIGS. 2C and 2D are view of sample flags used in the sheet-rolling process.
Figure 2D:
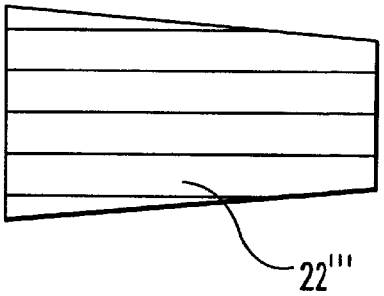
Figure 2E:
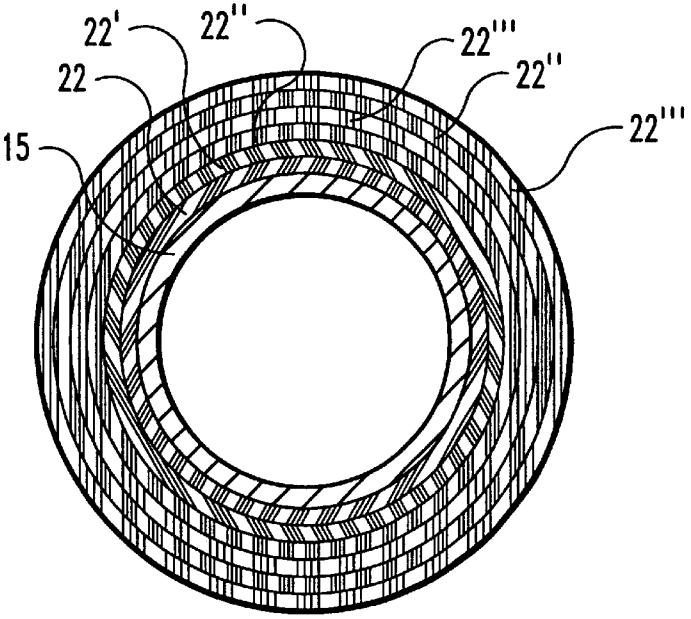
FIG. 2E is a cross-sectional view of a shaft made with the sheet-rolling process.

A sheet-rolling process is illustrated in FIGS. 2A–2E. In FIG. 2A flag or tapered sheet 22 having fibers at an angle, such as 45°, is rolled around a mandrel 15 to form a first layer or ply. Next, flag 22' having fibers at the opposite angle to flag 22 is rolled around mandrel 15 and first sheet 22, as shown in FIG. 2B. Additional plies such as 22' and 22" in FIGS. 2C and 2D or more angled plies can then be rolled to form a sufficient number of layers to reach a desired thickness and weight. Short flags, such as flag 22", are sometimes applied to the tip section for reinforcement and/or to provide an oversized finished section which may be sanded. A cross-section of a six ply shaft is illustrated in FIG. 2E included angled flags 22 and 22', a longitudinal flag 22', a short flag 22" and then a longitudinal flag 22' and a short flag 22" again.

The angle of the fibers in a ply can range from 0° to 90° from the longitudinal axis of the mandrel, although intermediate angles in sheet-rolled plies must be balanced with a ply having fibers angled in the opposite direction. Flags with longitudinal fibers (0°) have more effect on flex and bending strength, while fibers with higher angles have more effect on torque. Once a sufficient number of layers are applied, the shaft is cured and sanded for finishing. Shafts made with sheet-rolling alone are often criticized as mechanically inconsistent.

Figure 3A:
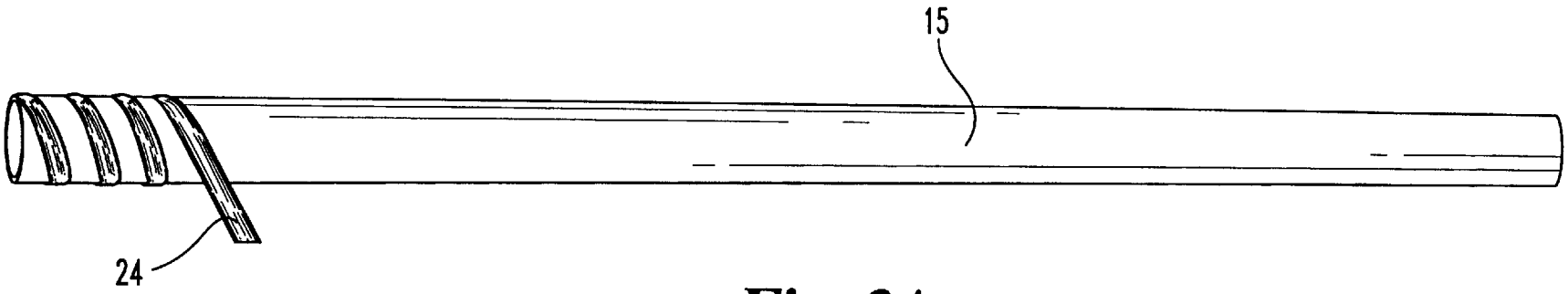
FIGS. 3A and 3B are perspective views of the process of filament winding used in one embodiment of the present invention.
Figure 3B:
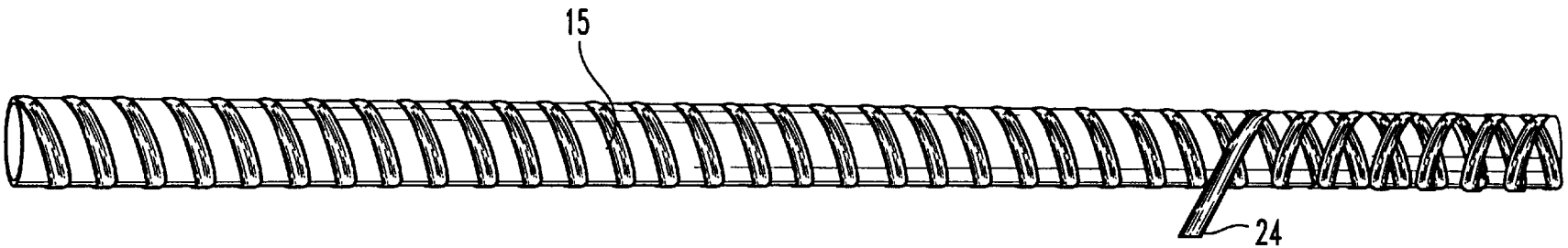

Filament wrapping, as illustrated in FIGS. 3A and 3B, is a more exact process than sheet-rolling and involves precise equipment and control to create a desired shaft. Instead of using a sheet 22, one or more resin impregnated tows 24 are individually wound back and forth around the mandrel 15 at an angle to form a layer or ply. A tow consists of a number of individual fibers. Typical tows range from 2,000 to 80,000 fibers, such as 3K, 6K, 12K, 48K and 80K tows, with preferred tows having approximately 12,000 fibers.

After a tow is wound one direction on a shaft, the angle of winding is reversed so that a particular layer or ply may have windings at opposite angles. Normally a number of plies form a core with additional filament wound plies forming the outer layer. Filament winding is often computer controlled, allowing precise control of the winding process to change the winding angle between plies or during a ply, to adjust ply thickness and/or to select the placement of individual fibers. Filament winding also allows the introduction of different weave patterns, helping to control weight and flex. Filament winding results in a higher degree of mechanical consistency that sheet-rolling.

Figure 4:
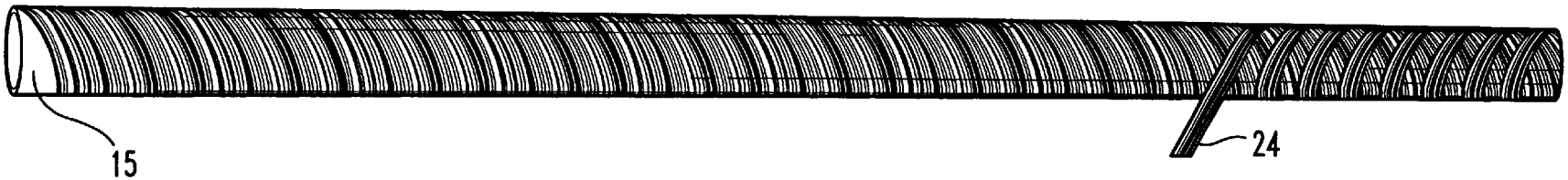
FIG. 4 is a perspective view of filament winding over sheet-rolling wrapping in one embodiment of the present invention.

One example of a hybrid composite, illustrated in FIG. 4, has a core of several plies formed on mandrel 15 by sheet-rolling with flags such as flag 22 and an outer layer of several filament wound plies placed over the core using tows 24. A hybrid composite having a core of sheet-wrapped layers and an outer layer of filament wound layers provides more combinations of attributes than sheet-rolling or filament winding alone. The present invention focuses on filament wound and hybrid composite shafts.

In addition to filament wound and hybrid composite construction, golf shafts made in accordance with the present invention take advantage of the properties provided by metal-coated fibers. The fibers are typically made of carbon, glass or other known materials, and are made individually in filament form, or held in a parallel resin matrix to create a sheet or prepreg form, depending on the desired result. In the prepreg form, all or a portion of the fibers in the parallel matrix may be metal coated. Examples of coating metals which may be used on fibers include: nickel, titanium, platinum, zinc, copper, brass, tungsten, cobalt, gold and silver. In addition to different visual effects, various metals, such as copper and nickel, have varying attributes and are used in different proportions to provide different degrees of weight, strength, and vibration absorption.

The metal coating may be vapor deposited on the fibers; alternately the metal coating may be electroplated onto the fibers. The metal coating may bond to the fibers or form sheaths around them. By way of illustration, the metallic coating may have a thickness between 400 Angstroms and 2.5 microns depending on the desired weight and appearance. Composite Materials L.L.C. of Mamaroneck, N.Y. sells certain of these coated fibers under the trade name Compmat. Certain other metal-coated fibers can be obtained from Inco Specialty Powder Products. Although the percentage of metal by weight may range from 0–99%, a preferred range for metal is 10–60% by weight, with a more preferred range being 40–45% by weight in flags for sheet-rolling and 20–26% by weight in tows for filament winding.

Figure 6:
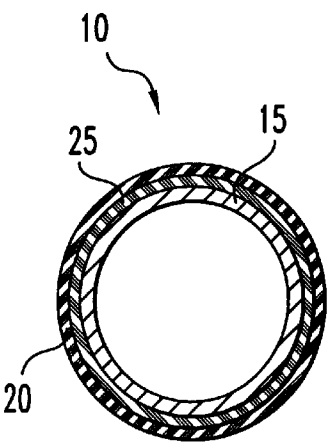
FIG. 6 is a cross-sectional view of a shaft according to one embodiment of the present invention.
Figure 5:
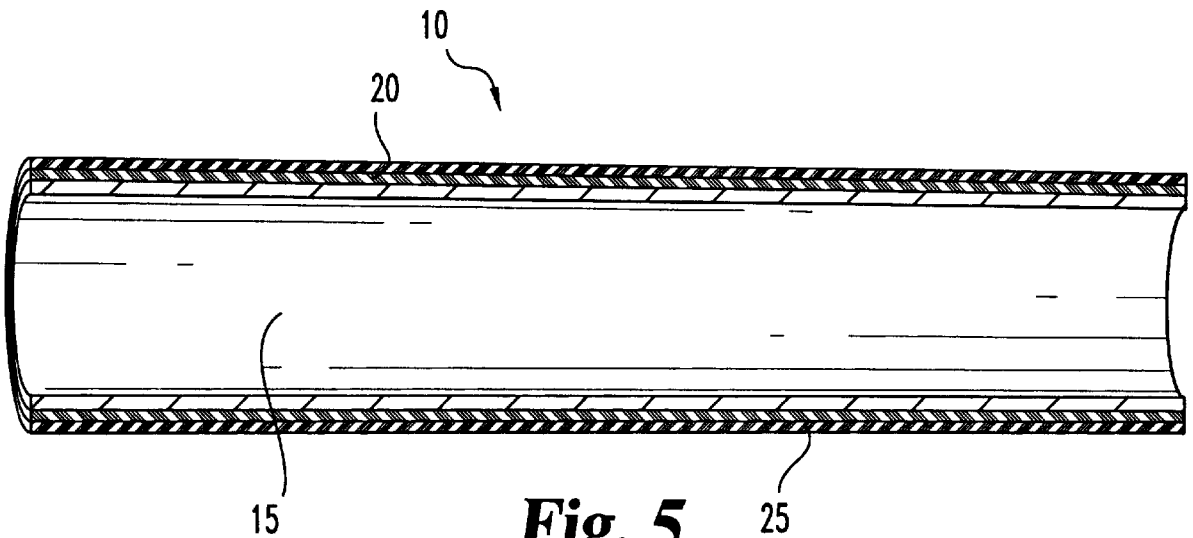
FIG. 5 is a longitudinal cut-away view of a shaft according to one embodiment of the present invention.

As illustrated in FIGS. 5 and 6, embodiments of the invention include core 20 covered by outer layer 25. In one embodiment, a composite body 10 is made from a number of layers sheet-rolled or filament wound or a combination thereof to form core 20, and a number of plies filament wound over core 20 to form outer layer 25. Typically there are about 4–10 plies in a composite body 10.

In one embodiment, the shaft includes metal coated fibers in core 20 and outer layer 25. As an alternate to having metal-coated fibers in the core and outer layer, a limited number such as one to three of the plies in outer layer 25 may include tows with metal-coated fibers. When each metal-coated tow is added uniformly to the final shaft, additional weight is added uniformly, changing the feel, but not having a substantial effect on other properties such as flex, torque, bending or impact strength.

By way of further illustration, FIGS. 11A–11D show diagrammatic views of the plies used in one embodiment 100 of the present invention. Non-metal-coated tows are filament wound at 45° to form first ply 110. First ply 110 is covered with second ply 112 of non-metal-coated tows filament wound at an angle of 10°. A longitudinal or 0° flag 114 is then sheet-rolled around second ply 112. A top or outer ply 116 of metal-coated tows is filament wound over flag 114 at an angle between 5° and 25°. The shaft is then finished by curing, sanding and painting.

Figure 7:
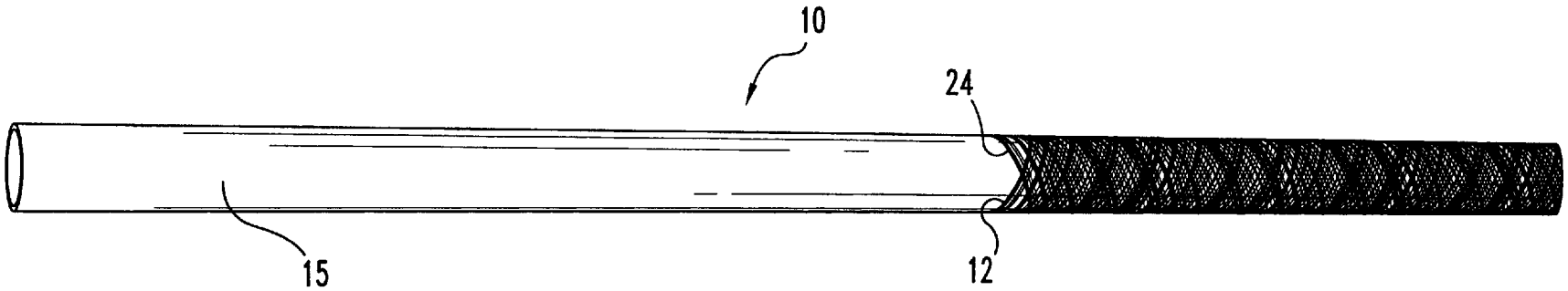
FIG. 7 is an alternate preferred embodiment of a shaft according to the present invention.
Figure 8:
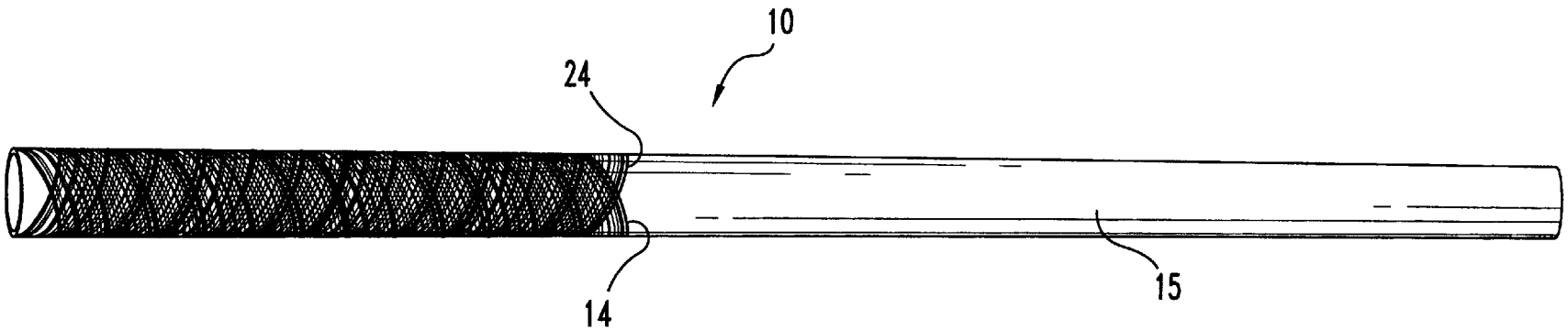
FIG. 8 is an alternate preferred embodiment of a shaft according to the present invention.

In alternate embodiments, illustrated in FIGS. 7 and 8, metal-coated fibers can be filament wound non-uniformly to be added to specific, desired portions of the shaft. For example, metal-coated fibers can be added to the lower portion of the shaft near hosel section 12, up to approximately one-third of the shaft, lowering the balance point of the shaft, and increasing the weight and strength at the hosel connection. Conversely, metal-coated fibers can be added near grip section 14 of the shaft, up to approximately one-third of the shaft, to raise the balance point and weight.

Figure 9:
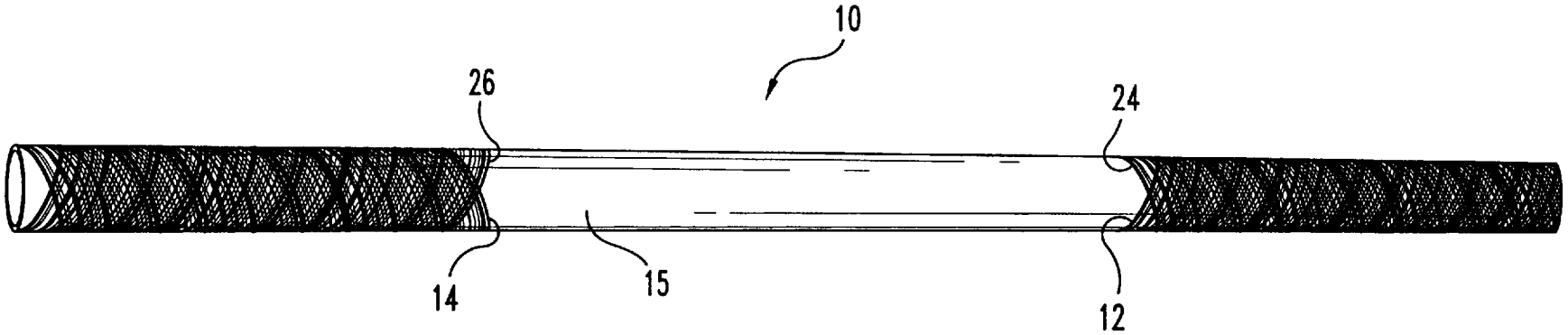
FIG. 9 is an alternate preferred embodiment of a shaft according to the present invention.

In further embodiments, with one example illustrated in FIG. 9, the same or different metal coated fibers are added to only particular portions of the shaft. For example, fibers coated with a first metal 26 are applied to grip section 14 while fibers coated with a second metal 24 are applied to hosel section 12 to adjust the weight, flex points, torque, and strength and to provide a unique look. In one example, copper coated fibers are added to hosel section 12 while nickel coated fibers are added to grip section 14.

The particular vibration, feel, torque, flex and overall weight of a club can be tuned by varying the percentage and thickness of the metal fibers in each layer. Additionally, the precise control in the filament winding process assists in customizing a shaft to an individual golfer's preference or needs by concentrating or reducing the metal-coated fiber percentage in specific areas to add weight to predetermined points on the shaft, tuning the balance point.

Figure 10:
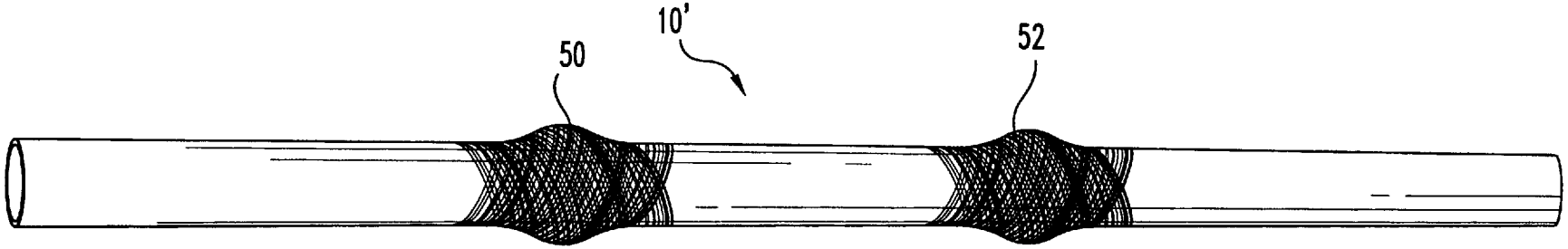
FIG. 10 is an alternate preferred embodiment of a shaft according to the present invention.
Figure 11A:
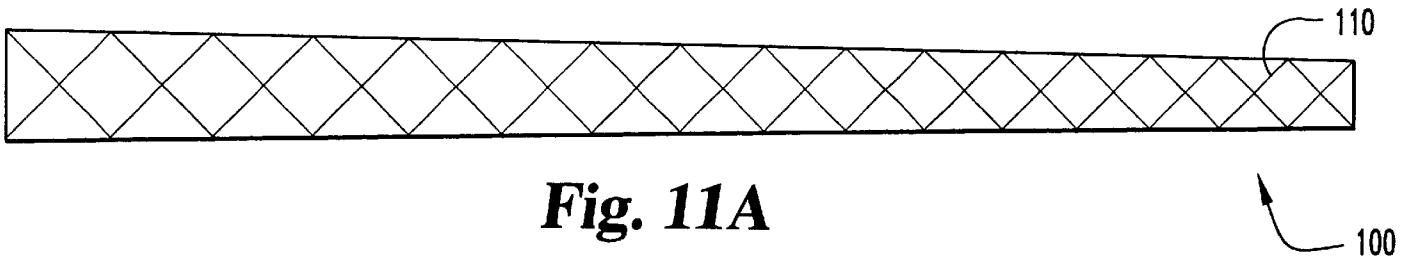
FIGS. 11 A, 11B, 11C and 11D are diagrammatic views of layers of a shaft made according to one embodiment of the present invention.
Figure 11B:
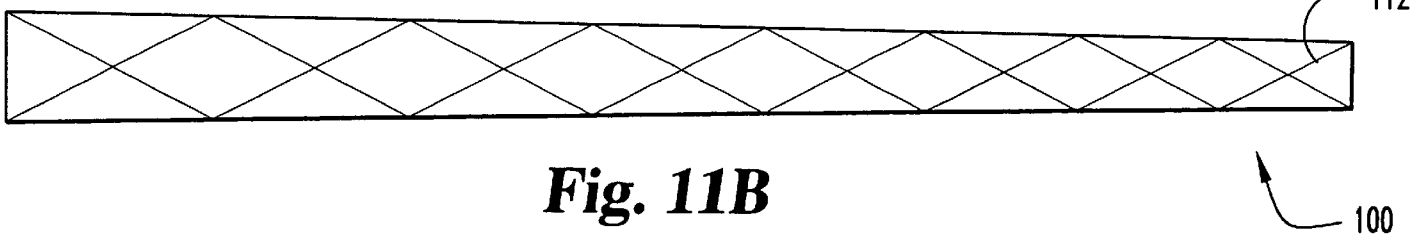
Figure 11C:
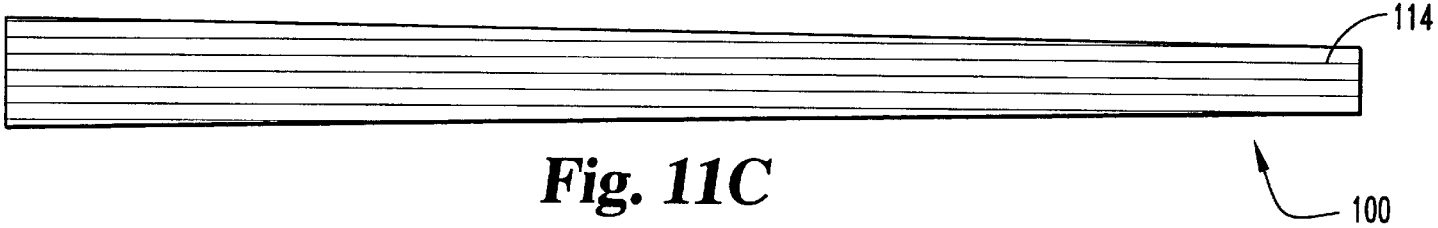
Figure 11D:
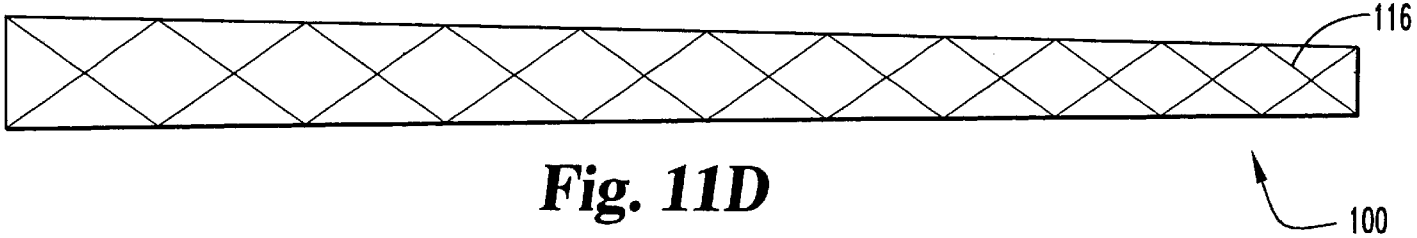

The metal also absorbs part of the impact force during use to reduce shock transmitted to the user and to minimize stress and cracking in the shaft. In another embodiment, shafts may be manufactured to form a shaft 10' with two flex points 50 and 52, illustrated in FIG. 10, such as in U.S. Pat. No. 5,496,028 issued Mar. 5, 1996 to Chien, hereby incorporated by reference.

In some embodiments, a diamond weave is used with the filament winding to add a diamond appearance to the shaft. As a decorative and protective feature to assist with finishing, a scrim layer may optionally be placed as an outer mask on a shaft and may be clear or include a design.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A composite golf club shaft having a grip portion and a hosel portion and formed from multiple fiber reinforced graphite plies, comprising:

a) a core formed of one or more either filament wound or sheet-wrapped fiber plies; and, b) an outer layer around said core, said outer layer including i) a first filament wound portion including filaments coated with a first metal and wound to concentrate a first amount of weight in a first location on said shaft; and, ii) a second filament wound portion including filaments coated with a second metal and wound to concentrate a second amount of weight in a second location on said shaft;

c) wherein said first metal is different from said second metal.

2. The golf club shaft of claim 1 wherein said first and second metals are chosen from the group consisting of: nickel, titanium, platinum, zinc, copper, brass, tungsten, cobalt, gold and silver.

3. The golf club shaft of claim 2 wherein said first metal is nickel.

4. The golf club shaft of claim 3 wherein said second metal is copper.

5. The golf club shaft of claim 4 wherein said first location is said grip portion.

6. The golf club shaft of claim 5 wherein said second location is said hosel portion.

7. A composite golf club shaft having a grip portion and a hosel portion and formed from multiple fiber reinforced graphite plies, comprising:

a) a core formed of one or more either filament wound or sheet-wrapped fiber plies; and, b) an outer layer around said core, said outer layer including i) a first filament wound portion including filaments coated with a first metal; and, ii) a second filament wound portion including filaments coated with a second metal;

c) wherein said first metal is different from said second metal.

8. The golf club shaft of claim 7 wherein said first and second metals are chosen from the group consisting of: nickel, titanium, platinum, zinc, copper, brass, tungsten, cobalt, gold and silver.

9. The golf club shaft of claim 8 wherein said first metal is nickel.

10. The golf club shaft of claim 9 wherein said second metal is copper.

* * * * *